US005357246A

United States Patent [19]

Wendelken, Jr.

[11] Patent Number: 5,357,246

[45] Date of Patent: Oct. 18, 1994

[54] TORSO-MOUNTED SIGNAL DEVICE

[76] Inventor: Martin E. Wendelken, Jr., P.O. Box 176, New Milford, N.J. 07407

[21] Appl. No.: 872,362

[22] Filed: Apr. 23, 1992

[51] Int. Cl.[5] ..... G08G 1/095

[52] U.S. Cl. ..... 340/908; 340/321; 200/60; 40/586; 116/63 P; 362/169

[58] Field of Search ..... 340/321, 908, 908.1; 200/60; 40/586; 116/63 R, 63 P; 362/157, 169

[56] References Cited

U.S. PATENT DOCUMENTS

| | | | |
|---|---|---|---|
| 1,777,379 | 10/1930 | Powell et al. | 340/321 |
| 2,114,635 | 4/1938 | Marshall | 340/321 |
| 2,705,751 | 4/1955 | Harris et al. | 340/321 |
| 2,799,854 | 7/1957 | Barnes | 340/321 |
| 2,825,898 | 6/1956 | Stanley | 340/321 |
| 2,829,362 | 5/1954 | Terrill . | |
| 3,046,521 | 7/1962 | Cantwell et al. | 340/908 |
| 3,729,706 | 10/1970 | Hein . | |
| 3,810,091 | 5/1972 | Hoover . | |
| 3,921,131 | 1/1974 | Buono . | |
| 3,995,250 | 11/1976 | Ferree . | |
| 4,032,883 | 6/1977 | Gibson . | |
| 4,090,186 | 12/1976 | Renner | 340/321 |
| 5,001,475 | 3/1991 | Sceuln | 340/900 |
| 5,010,336 | 3/1991 | Evanston | 340/907 |
| 5,070,436 | 12/1991 | Alexander et al. | 340/321 |

FOREIGN PATENT DOCUMENTS

| | | | |
|---|---|---|---|
| 190187 | 12/1922 | United Kingdom | 340/321 |

*Primary Examiner*—Donnie L. Crosland

[57] ABSTRACT

A portable torso mounted signal device for communicating traffic directives to pedestrians, airport terminal, and vehicular traffic comprising of four strategically placed colored lenses on a board (10); board (10) is shaped in such a manner as to accommodate two lenses (12,14), circular in shape which are vertically positioned, a second pair of lenses arrow shaped (16,18), horizontally positioned on the face of the signal device. The device is self-contained in that a harness (60), power source (66), electrical circuits, and electrical switches (82) to control illumination of colored lenses are all fixed to this same board. Indicating lights (74) on the posterior surface inform the operator which lenses are illuminated during operation. The signal device is readily portable, requires no assembly, ready for immediate use.

1 Claim, 3 Drawing Sheets

FIG. 1
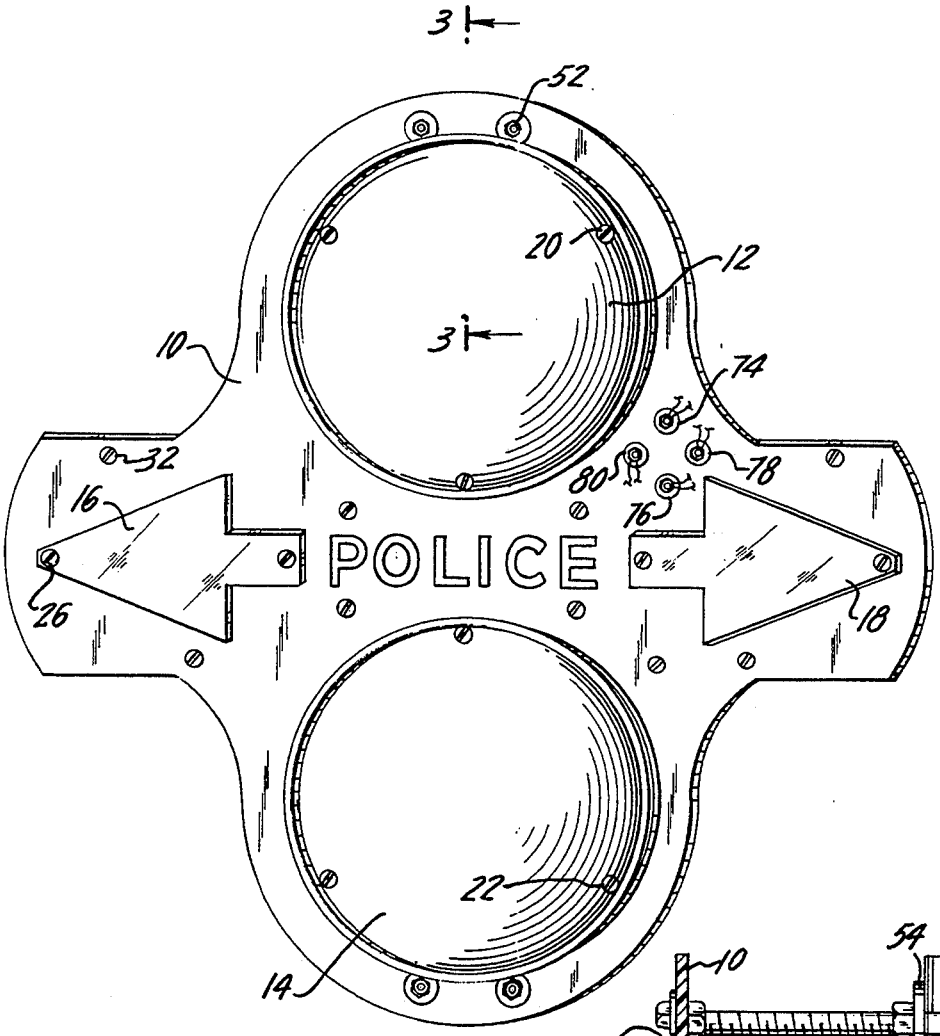
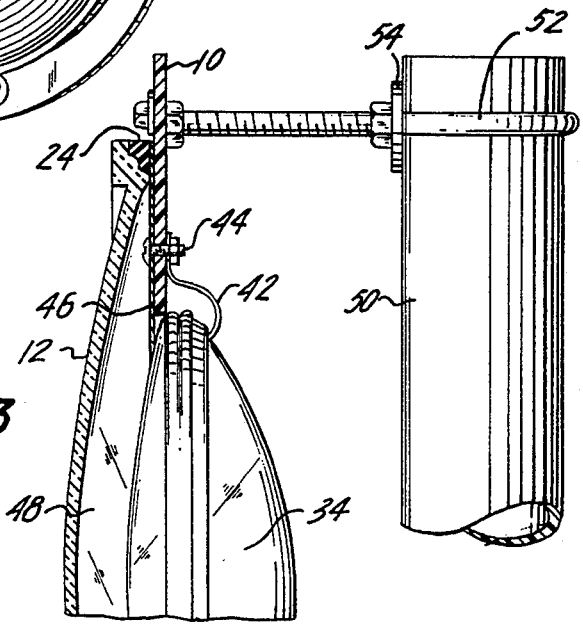
FIG. 3

TORSO-MOUNTED SIGNAL DEVICE

BACKGROUND OF THE INVENTION

1. Field of the Invention

The field of the invention relates to portable traffic control devices, more exactly those used by police officers and alike for short periods in both emergency and non-emergency situations.

2. Brief Description of Prior Art

The use of lighted traffic signals is world renowned. The standard red and green for "stop" & "go" respectively is an effective way to direct automotive traffic with little confusion. Almost all of the traffic signals one encounters today are mounted, fixed devices on poles or other non-portable structures. The use of similar traffic signal devices which are portable like those disclosed in U.S. Pat. No. 3,995,250; 1976 Ferree, are large and cumbersome and not intended to be held or worn by the operator. Attempts to downsize portable traffic signals are disclosed in U.S. Pat. Nos. 2,829,362, Terrill, 1954; 3,921,131, Buono, 1974; and 4,032,883, Gibson, 1977; which are smaller in size, but all require assembly, are ground supported, and again are not intended to by worn by the operator. It should be noted that none of the above signal devices are presently in wide use. Present state of the art portable signal devices which are used include held devices which mainly comprise of a flashlight with a cone lens on its lighted end, signs with a variety of indicia written on its face, and white gloves. Though these devices are effective for their intended purposes and are simple to use, they lack the ability to communicate without some form of movement or random motion. To fill this need more attempts have been made to improve communication between the operators of portable signal devices and the motorist which are disclosed in U.S. Pat. Nos. 2,825,898, Stanley, 1958; 2,799,854, Barnes, 1957; and 4,090,186, Renner, 1976. These devices utilize colored illuminated lenses and/or indicia, and improve the communication, but do require the operator to hold the device. Still those with a written message are only applicable if the indicia relates to a given situation. Furthermore, the prior art such as British Patent No. 190,187 Harriss, 1921 and U.S. Pat. No. 2,705,751 D. C. Harris Et. Al. 1955, provides no means of directing motorists to turn left or right without some motion from the director. Still further improvements to portable traffic control devices are disclosed in U.S. Pat. No. 5,001,475, Scevin, 1991; which utilizes a simulated officer holding a signal light. While this device will eliminate the need of holding a signal light, it does require assembly and is of sufficient size that a "utility van" is needed for transportation to its intended site of use. In addition it is clear it is not intended to be worn by the operator and because of its size it is unlikely to be carried in the trunk of a police car or motorcycle making it unavailable for immediate emergency use.

OBJECTIVES AND ADVANTAGES

In view of the fact that the prior art fails to provide for the stated needs in communication and lacks flexibility in a variety of situations, it becomes apparent for the need of a portable signal device which is worn by the operator, has the ability to communicate the operator's directives without motions, in various situations and is operable independent of lighting or weather conditions.

A principal objective of the invention is to insure positive communication between the operator of the portable signal device and the intended receiver of the directive.

Another objective is to use signals which the general public are already familiar with such as red light for "stop", green light for "go", and arrow lenses for turning directives.

Still another objective is to reduce operator fatigue by having the user of the invention mount it on ones torso which eliminates the need to hold a signal device in ones hand during operation.

A further objective is to have a signal device which is fully portable, easy to operate, and requires no assembly.

Yet another objective is to provide a signal device which has flexibility in its applications, eliminates random movements, and is operable regardless of lighting or weather conditions.

Still another objective of this invention is to keep the operator of the signal device advised of which lens or lenses are being utilized in an effort to eliminate incorrect directives from being sent.

Another objective is to have available for emergency use, a traffic signal device which can be carried in the trunk of automobile and whose power cells are constantly being recharged making it ready for emergency use.

Still another objective is to improve visualization of the traffic director especially during adverse or poor lighting conditions.

BRIEF DESCRIPTION OF DRAWINGS

These objectives along with other advantages will become apparent with the following descriptions and clarified with referral to the drawings provided.

FIG. 1 is a view of the torso signal device as seen looking directly at the face or front surface.

FIG. 3 is a longitudinal, cross-sectional view of the torso mounted signal device shown in FIG. 1 as taken in the direction of arrows 3—3 thereof.

Reference Numerals In Drawings

Figure 2:
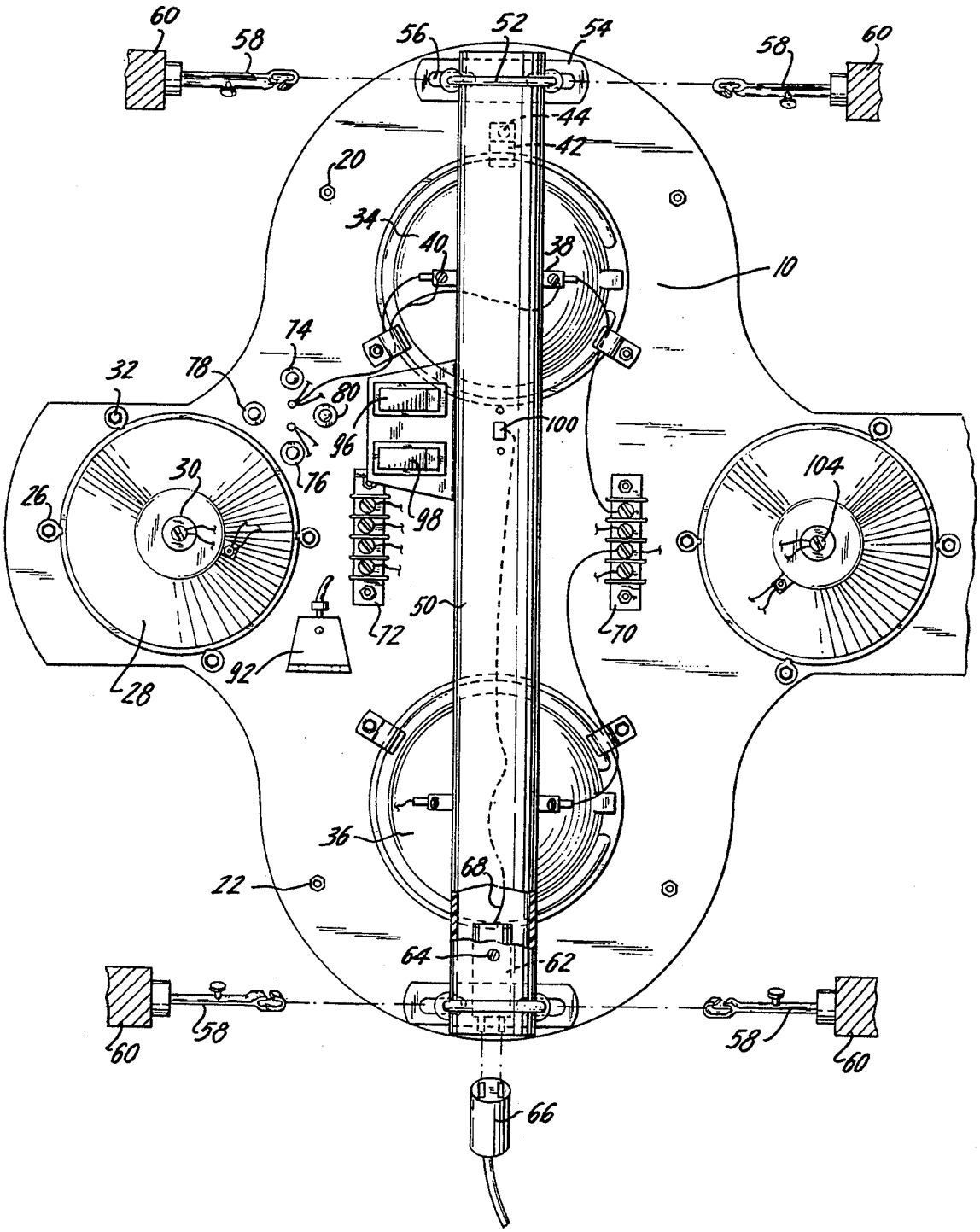
FIG. 2 is a view of the posterior aspect of the torso mounted signal device.

| | | | |
|---|---|---|---|
| 10 | body | 12 | red circular lens |
| 14 | green circular lens | 16 | left directional lens |
| 18 | right directional lens | 20 | screw (red lens) |
| 22 | screw (green lens) | 24 | gasket |
| 26 | screw (lt. dir. lens) | 28 | reflector assembly |
| 30 | lamp (rt. dir. lens) | 32 | clip (for reflector) |
| 34 | lamp (red circ. lens) | 36 | lamp (green circ. lens) |
| 38 | + terminal (lamp) | 40 | − terminal (lamp) |
| 42 | fastener clip | 44 | fastener screw |
| 46 | metallic reflector | 48 | opening in board |
| 50 | elongated tube | 52 | semi-circular clamp |
| 54 | crossmember | 56 | crossmember slot |
| 58 | mounting clip | 60 | connecting strap |
| 62 | male power plug | 64 | screw (power plug) |
| 66 | female power plug | 68 | power line |
| 70 | + central terminal | 72 | − central terminal |
| 74 | red indicator lamp | 76 | green indicator lamp |
| 78 | right indicator lamp | 80 | left indicator lamp |
| 82 | remote unit | 84 | remote switch top |
| 86 | remote switch bottom | 88 | remote switch right |
| 90 | remote plug male | 92 | remote plug female |
| 94 | not used | 96 | switch red lens |
| 98 | switch green lens | 100 | switch dir. lenses |

-continued

| Reference Numerals In Drawings | |
|---|---|
| 102 remote switch left | 104 lamp (lt. dir. lens) |

DESCRIPTION OF EMBODIMENT-FIGS. 1 to 5

Referring to FIG. 1, the torso-mounted portable signal device is centered around a board 10 which is preferably made of a thin, durable, light weight substance such as plexiglass or other such material, which serves as the foundation of the device and its related parts. To this board 10 four lenses, are fixed to the front face: a red lens 12, a green lens 14, a left directional lens 16, and a right directional lens 18.

Red circular lens 12 located on the upper central area of board 10 and is secured to is face utilizing three screws like that shown; screw 20. This arrangement allows one to remove and change the lens 12 if and when it becomes necessary. Of course a more permanent type of fixation is attained by using rivets or by making lens 12 part of board 10 as in a molded structure. To insure a moisture tight seal between red lens 12 and board 10 a rubber gasket 24 (FIG. 3) is utilized.

Green circular lens 14 located on the lower central area of board 10 and is secured to its face in the same fashion utilizing three screws like that of screw #22 and employs the same type of gasket 24 (FIG. 3) between green lens 14 and board 10.

Continuing with FIG. 1 left directional lens 16 (arrow shaped) is located on the right extremity of board 10 while right directional lens 18 is located on the left extremity. Directional lenses 16,18 are secured to the face of board 10 each using two screws like that shown, screw 26. Directional lenses 16 & 18 are green in color.

Directing ones attention to FIG. 2, the posterior aspect of torso signal device, two seal beam halogen lamps 34 and 36 are utilized to illuminate red lens 12 and green lens 14 respectively. Each lamp (34,36) is fixed to board 10 directly behind its respective lens and is secured by three fasteners. A fastener is comprised of a clip 42 and associated screw 44 which affords a secure bond to board 10. Terminals 38,40 conduct power to lamp 34 producing beams of light which pass through opening in board 10 and illuminate red lens 12. Green lens 14 and lamp 36 function in the same fashion.

For right directional lens 18 a reflector assembly unit 28 along with a lamp 30 is position behind directional lens 18. Lamp 30 is located in the center of reflector assembly unit 28 to gain full access of the reflector capability. Beams of light pass through an opening in board 10 and illuminate directional lens 18. Reflector assembly unit 28 is secured to board 10 using four clips with its associated screw like that of #32. Left directional lens 16 employs the same arrangement for illumination by utilizing lamp 104.

Continuing with FIG. 2, attention is directed to an elongated tube 50 which runs along the length of the posterior aspect of the signal device and is secured to board 10 by using a semi-circular clamp 52 along with a crossmember 54. This combination encircles elongated tube 50 and provides a secure bond to board 10. A second such combination of clamp and crossmember is employed on the opposite end of elongated tube 50 fixing that end to board 10. Elongated tube 50 serves as the foundation for three electric switches 96,98,100, and provides the capacity to house a power source such as a number of dry cells within its center. Preferably a rechargeable external power source can be connected through a male power plug 62 (shown) which is secured to elongated tube 50 by screw 64. Electric current passes from an external power supply through a wire and a female power plug 66 and energizes the torso signal device when connected to male power plug 62. Power line 68 carries the electrical current to central terminals 70 and 72.

Continuing with FIG. 2, torso-mounted signal device utilizes four mounting clips 58 which attach to crossmember slots 56, two at each end of elongated tube 50. Connecting clips 58 are the distal ends of straps 60 which in turn are part of a vest or continue to make up a harness which is worn by the operator.

FIG. 2 illustrates four indicating lights 74,76,78,80 each of are directly fixed to body 10. These same four indicating lights are color and position coordinated as lenses 12,14,16,18 mounted on the face of body 10, whose operation is explained below.

Directing attention to FIG. 3 a detailed drawing is provided illustrating a longitudinal cross sectional view of the device shown in FIG. 1 taken in the direction of arrows 3—3. FIG. 3 shows the relationship of red lens 12 attachment to board 10 with gasket 24 providing a water tight seal. This view also illustrates the attachment of elongated tube 50 utilizing semi-circular clamp 52 and crossmember 54 and its attachment to board 10 of the signal device. In addition this cross sectional view reveals the relationship of illuminating lamp 34, fastener clip 42 along with its associated screw 44 and its attachment to board 10. Beams of light produced by lamp 34 pass through an opening 48 in board 10 and illuminate red lens 12. Additional reflection of light is provided by a metallic reflector 46 to insure brighter and full lens illumination.

Figure 4:
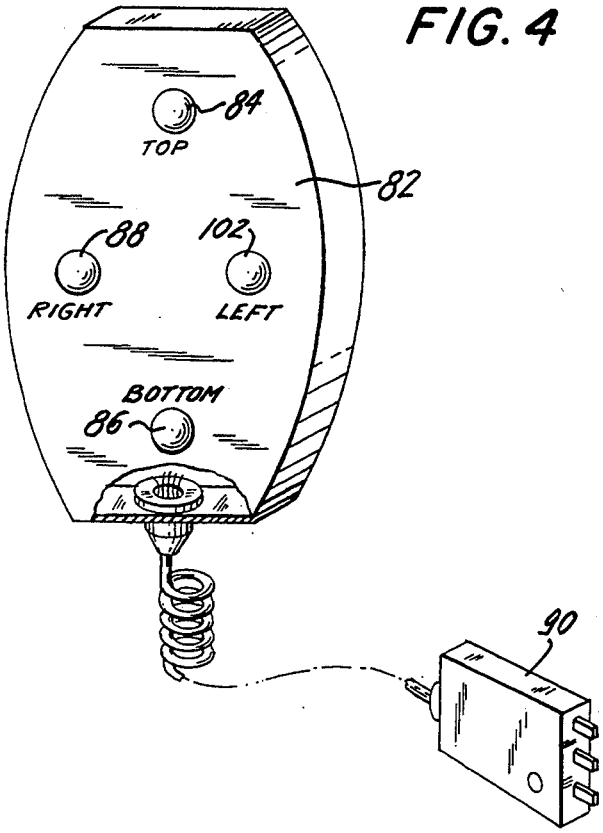
FIG. 4 is a prospective view of a remote control unit.

FIG. 4 illustrates a remote control unit 82 and is comprised of switches 84,86,88,102 which are fixed to its face and become functional when connected to torso-mounted signal device. This is accomplished through a coiled wire and remote male connecting plug 90 which inturn attaches to remote female connecting plug 92 (FIG. 2) located on the posterior face of board 10.

Figure 5:
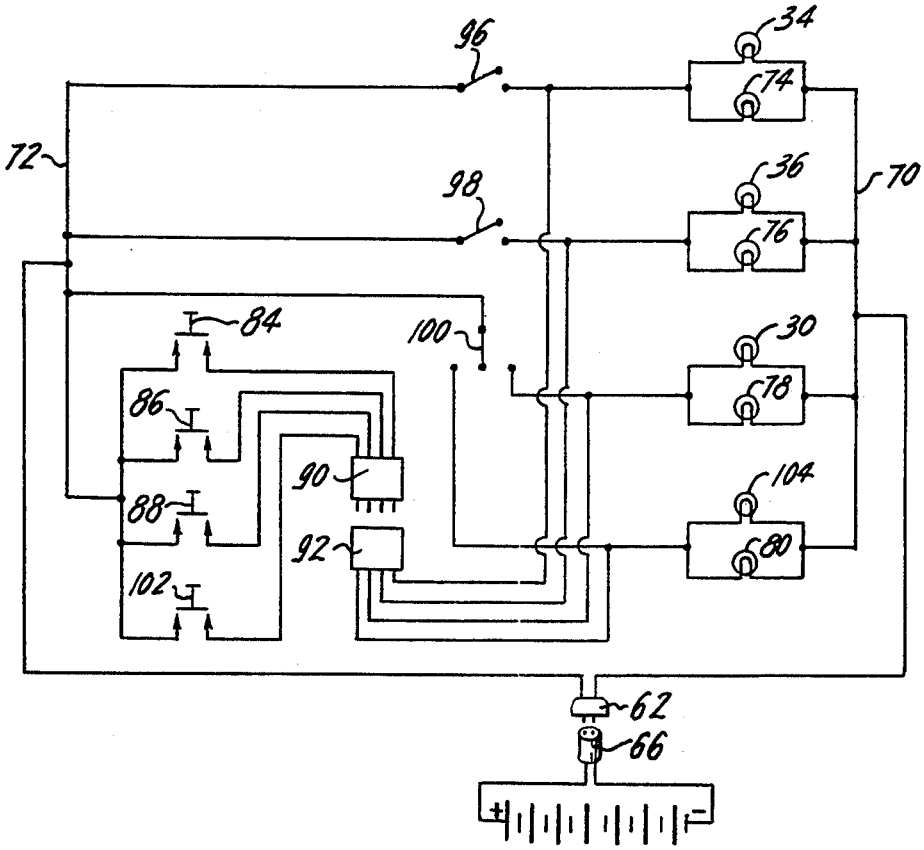
FIG. 5 is a schematic wiring diagram of the circuit used by the torso-mounted signal light.

FIG. 5, is a wiring diagram which illustrates electric switches 84,86,88,102 contained on remote control unit 82 and remote connecting plugs 90,92; electric switches 96,98,100 fixed to elongated tube 50; connection of a power source through plugs 66 and 62; illuminating lamps 34,36,30,104 for lenses; and its respective indicating lamps 74,76,78,80, all utilized by torso-mounted signal device inclusive of those mentioned in the above description and drawings.

OPERATION

FIGS. 1, 2, 4

Torso-mounted signal device is simple to operate. First the operator must don the signal device by placing ones arms through a vest or harness with its opening to the back. The operator then secures the vest with a number of closures. The signal device now covers the anterior aspect of chest with lenses (12,14,16,18) facing outward. The operator grasps remote control unit 82 in one hand, faces the oncoming traffic and is ready to send a directive.

A common situation encountered by a traffic officer is directing vehicular traffic at a cross section where vehicles converge from four opposite directions. The operator, for example sees a motorist approaching and wishes to send a "stop" signal. The officer merely faces the motorist, depresses remote control switch 84 which illuminates red lens 14 conveying a "stop" signal.

The signal device has the ability to convey a complex directive by illuminating more than one lens. The traffic officer now wishes to prevent the motorist from crossing the intersection, but instead will allow the motorist to turn right. The officer faces the motorist, depresses remote switch 84 and remote switch 88. This illuminates red lens 14 and green directional lens 18, which allows the motorist to turn right but not to move forward across the intersection.

It becomes clear that many different directives are available by changing the sequence and number of remote switches (84,86,88,102) depressed or combinations of lenses (12,14,16,18) illuminated. A few examples follow:

| Directive | Lens Lit | Depress Remote Switch(es) |
|---|---|---|
| Stop | 12 | switch 84 |
| Go | 14 | switch 86 |
| Stop forward, Go lt. only | 12,16 | switches 84, 102 |
| Stop forward, Go lt. & rt. | 12,16,18 | switches 84, 102, 88 |
| Stop rt., Go forward & lt. | 12,14,26 | switches 84, 86, 102 |

To insure that the proper directive is being sent to a motorist, torso-mounted signal device has on the posterior surface lamps which illuminate when its respective lens is being utilized. When red lens 12 is illuminated by lamp 34 through remote switch 84; remote switch 84 also illuminates red indicator lamp 74. Green lens 14, and directional lenses 18,16 have indicator lamps 76,78,80, to keep the traffic officer informed of their status.

Although the portable signal device is intended to be worn by its operator, switches 96,98,100, located on elongated tube 50 enable a traffic officer to use the device as a hand held unit for short periods. Switch 96, illuminates lamp 34, indicator lamp 74, and red lens 12 when depressed. Switch 98, operates green lens 14, and its respective lamps, while switch 100 is a two position type that controls both directional lenses 16,18 and their respective lamps. As stated above, a combination of different directives can be obtained by utilizing switches 96,98,100. To operate the signal device in this mode, it would be prudent to disconnect remote unit 82 by unplugging remote male plug 90 from remote female plug 92. Also one would be required to remove the signal device from its harness by disconnecting four mounting clips 58 from each crossmember 54 at both ends of elongated tube 50.

The torso-mounted signal device is available for immediate emergency use at any location if carried in the trunk of a police car, mounted on a fire truck or other vehicle. Operation of portable traffic signal requires electrical power to illuminate its lenses. A rechargeable power supply is utilized by connecting female power plug 66 to male plug 62 on the lower end of elongated tube 50. When not in use female power plug 66 may be connected to a charging unit in the trunk of an automobile so it will be fully recharged when required for the next emergency.

Torso mounted signal device has many non-emergency uses such as when operated by crossing guards, dispersement of stadium traffic, and ground traffic at crowded airports.

SUMMARY AND SCOPE

After reading the description of the torso-mounted signal device, it becomes apparent that this device will provide its operator a simple way to control many types of traffic including vehicular, pedestrian, marine, ground aircraft, and others. The operator of the device selects the appropriate lens, illuminates it by pressing electric switches either remote or affixed, and is able to clearly communicate to the recipient of the signal, ones directives without motion or confusing written indicia. In addition the message is transmitted regardless of lighting conditions, and without having to hold the signal device. Furthermore torso-mounted signal device has additional advantages in that

- it does not require special transportation to the operation site and no assembly is needed;
- it permits immediate use in an emergency situation;
- it uses signals which the general public is already familiar with;
- it gives traffic officer a greater chance of being seen in poor lighting conditions avoiding injury;
- it vastly improves on present state of the art portable hand held traffic devices being used; and
- it allow freedom of movement by its operator in that the signal device and related parts are self-contained.

The above description shall not be construed as limiting in ways in which this signal device may be practiced but shall be inclusive of many other variation by those skilled in the art who's changes or modification could be made without departing from the broad interests, intent, and true spirit of this invention.

Having described my invention what is claimed is:

1. An electronic portable torso mounted signal device for directing vehicular traffic comprising:

A plurality of translucent lenses attached to a board, two of said lenses being circular shaped, one being red in color and one being green in color, two of said lenses being arrow shaped, and green in color, said board including a midline defining upper and lower sections, and being constructed to include a left and right extremity which are centrally located and projecting laterally and perpendicular to said board's midline, wherein said left extremity includes one of said arrow shaped lenses attached thereto for directing oncoming traffic to turn right and said right extremity includes the second said arrow shaped lens attached thereto for signaling oncoming traffic to turn left; said red circular lens is centrally located on said upper section of said board, said green circular lens is centrally located on said lower section of said board, said lenses being illuminated by lamps mounted behind each of said lenses, a storage battery for supplying electrical current to said lamps, a plurality of switches being connected to said battery and said lamps to select and control the illumination of said lamps in singular or in combination, whereby a variety of directives with respect to traffic control are achieved.

* * * * *